United States Patent [19]

Suffa

[11] Patent Number: 4,518,341

[45] Date of Patent: May 21, 1985

[54] PRESS FOR MANUFACTURING PLATES, ETC.

[75] Inventor: Hilmar Suffa, Kochel am See, Fed. Rep. of Germany

[73] Assignee: Dorst Maschinen-und Anlagenbau Otto Dorst und Dipl.-Ing. Walter Schlegel & Co., Fed. Rep. of Germany

[21] Appl. No.: 585,528

[22] Filed: Mar. 2, 1984

[30] Foreign Application Priority Data

Mar. 30, 1983 [DE] Fed. Rep. of Germany ..... 3311685
Sep. 7, 1983 [DE] Fed. Rep. of Germany ..... 3332277

[51] Int. Cl.[3] ..... B30B 5/02; B28B 3/00

[52] U.S. Cl. ..... 425/405 H; 425/412; 425/415; 425/419; 425/423

[58] Field of Search ..... 425/405 R, 405 H, 412, 425/415, 419, 423, DIG. 19, DIG. 44

[56] References Cited

U.S. PATENT DOCUMENTS

| | | | |
|---|---|---|---|
| 2,519,661 | 8/1950 | Johnson | 425/DIG. 19 |
| 2,575,734 | 11/1951 | Schulman | 425/DIG. 19 |
| 3,156,958 | 11/1964 | Miller et al. | 425/DIG. 19 |
| 3,173,974 | 3/1965 | Mohr . | |
| 3,256,375 | 6/1966 | Bolelli et al. | 425/DIG. 44 |
| 3,520,961 | 7/1970 | Suda et al. . | |
| 3,594,877 | 7/1971 | Suda et al. | 425/405 H |
| 3,650,657 | 3/1972 | Witkin | 425/405 H X |
| 3,664,799 | 5/1972 | Wallick et al. | 425/405 H X |
| 4,043,724 | 8/1977 | Schubart | 425/405 H X |
| 4,128,375 | 12/1978 | Schubart | 425/405 H |
| 4,133,626 | 1/1979 | Schubart | 425/405 H |
| 4,330,250 | 5/1982 | Pinkas | 425/405 H X |
| 4,350,486 | 9/1982 | Croseck et al. | 425/405 H X |
| 4,482,515 | 11/1984 | Buhler et al. | 425/DIG. 44 |

FOREIGN PATENT DOCUMENTS

| | | | |
|---|---|---|---|
| 43019 | 1/1982 | European Pat. Off. | 425/405 H |
| 379391 | 8/1920 | Fed. Rep. of Germany . | |
| 1235787 | 12/1977 | Fed. Rep. of Germany . | |
| 512303 | 10/1971 | Switzerland . | |
| 1315523 | 5/1973 | United Kingdom | 425/DIG. 44 |

*Primary Examiner*—J. Howard Flint, Jr.
*Attorney, Agent, or Firm*—Price, Heneveld, Huizenga & Cooper

[57] ABSTRACT

A press is described for manufacturing plates, etc., having a press die which can be moved against a countermold for pressing, the press die being molded in accordance with the inner shape of the plate, etc., to be pressed, and having an elastic membrane closing a cavity in the countermold and mounted at its edge which is adapted to the dimensions of the edge of the finished plate. The membrane is provided with an annular slot corresponding to the base of the plate and is capable of having porcelain body in powder form distributed over it in the limits set by the mounting, when the press die is moved a distance away from the membrane, the cavity covered by the membrane being capable of being filled with a pressure medium which can be pressurized when the press die has been moved onto the porcelain body in powder form distributed over the membrane. The press die has a coating which is provided at the edge with a torus bulging towards the membrane. A self-contained annular groove may be provided in the edge of the membrane opposite this torus.

9 Claims, 6 Drawing Figures

Figure 1:
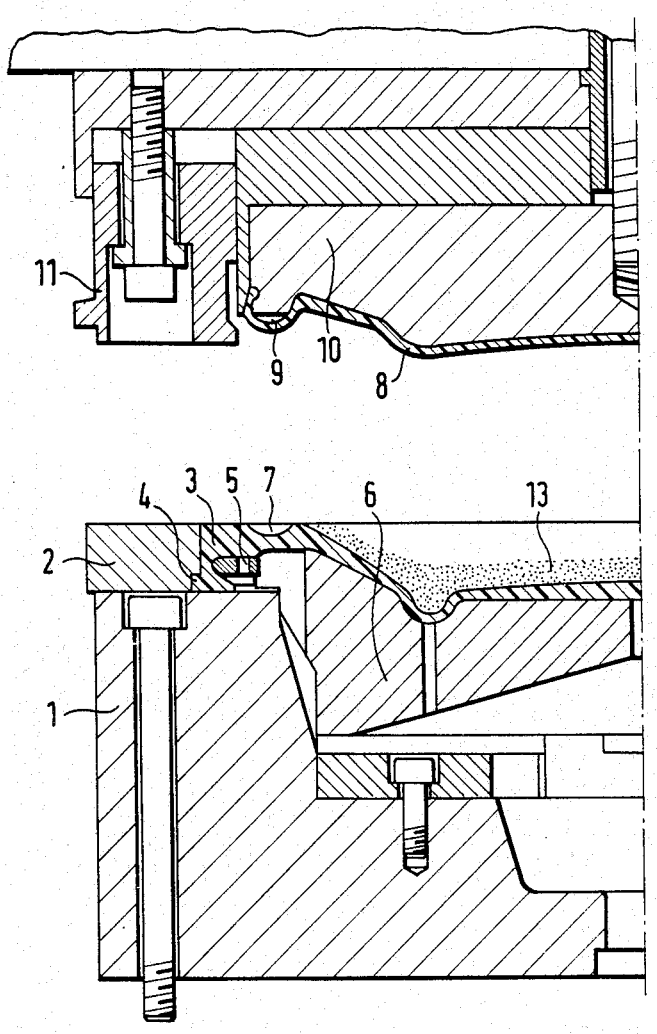

PRESS FOR MANUFACTURING PLATES, ETC.

The present invention relates to a press for manufacturing plates, etc., having a press die which can be moved against a countermold for pressing, the press die being molded in accordance with the inner shape of the plate, etc., to be pressed, and having an elastic membrane closing off a cavity in the countermold and mounted at its edge which is adapted to the dimensions of the edge of the finished plate, this membrane being provided with an annular slot corresponding to the base of the plate and being capable of having porcelain body in powder form distributed over it in the limits set by the mounting, when the press die is moved a distance away from the membrane, the cavity covered by the membrane being capable of being filled by a pressure medium which can be pressurized after the press die is moved onto the porcelain body in powder form distributed over the membrane.

This type of press is generally known from German Pat. No. 26 27 160.

The plate manufactured on a press according to German Pat. No. 26 27 160 has on its periphery an edge ending in a wedge shape due to the pressing method, and this edge must be removed in a further working operation using several plasterer's tools in order to obtain the desired roundness of the plate edge or rim. This kind of subsequent treatment is practically impossible for plates having a scalloped rim.

The reason why the plate rim ends in a wedge shape is that the pressed plate expands somewhat when released after the pressing process, i.e. its outside diameter grows larger, so that when the plate rim is held by the membrane or other parts of the press, it is quite difficult to lift off the plate and the plate might be damaged when being lifted off. If the plate rim ends in a wedge shape, on the other hand, the restraining forces are diminished. However, such a rim ending in a wedge shape is not desirable in the finished plate and must be rounded off again, involving a considerable loss of material. A reduction in material is practically impossible in the case of a scalloped rim, in particular in the recesses.

The invention is based on the problem of arriving at an arrangement in the rim area resulting in a plate rim which only needs to be reworked on its underside, but otherwise is freely exposed on the membrane after the press die has been moved away, and can thus be lifted off without difficulty.

This problem is solved according to the invention by providing the press die with a coating having at its edge an annular ring bulging in the direction of the membrane. This annular ring or torus is preferably a hollow torus.

This torus is placed on the membrane when the press die is applied. Since the membrane is acted upon on its underside by a pressure medium, the torus is displaced upwardly, whereby it can only give way towards the inside in the direction of the filling, i.e. the ceramic material on the membrane. When being pressed flat against the press die, it thus displaces the rim of the pressed material somewhat towards the inside. When the pressure forces of the pressure medium are removed, the torus can resume its shape because the membrane also resumes its shape. The plate can relax freely and there is no more danger of it being damaged when relaxing.

There has already been an attempt to solve the problem dealt with in the present invention. According to German Offenlegungsschrift No. 29 33 226.1, a self-contained annular groove is formed in the edge of the membrane on the surface facing the press die, the membrane being primarily acted upon by a pressure medium below this annular groove.

However, it has been shown that this solution cannot be the definitive one, because, according to this teaching, the edge or rim of the plate is placed in the membrane, which cannot be realized in the case of scalloped relief plates according to the present level of experience. It turns out that the pressed plate expands by approximately 0.8 to 1.8% so that its outside diameter increases accordingly and thus the plate rim is held by the membrane.

However, the teaching according to German Offenlegungsschrift No. 29 33 226.1 can be advantageously combined with the inventive teaching as in claim 1 and/or claim 2, since the torus on the press die is then placed in the annular groove arranged opposite it when the press die is placed on the membrane. Since the portion of the membrane located under the annular groove can primarily be acted upon by the pressure medium, the torus is concertedly pushed upwards and can give way towards the inside virtually only in the direction of the filling, i.e. the ceramic material. The effect which can be obtained by the basic idea of the invention is thus perfected and reinforced.

In the course of the further development of the inventive press it has turned out that the effective surface of the press die can have its diameter reduced even more favorably by subjecting the membrane to the pressure medium before the pressing process begins and after the membrane has been filled and the press die placed on it. Thus the coating increases on the outer periphery during relaxing after the pressing process, if the press die has on its periphery a coating provided on the rim with a torus bulging in the direction of the membrane.

The coating can be fixed and/or supported on the inner die portion when the coating on the press die has in the area of the inclined plane a projection extending over this inclined plane and hooked at its end via a bulge in a groove in the inner die portion. It is true that German Offenlegungsschrift No. 31 45 199 already discloses the division of the press die into an edge portion and an inner portion and the provision of the edge portion with an inner boundary surface extending on a slant from the inside to the outside, while the inner die portion is under spring action. However, the reduction of the diameter of the effective surface of the press die is very slight in this arrangement. This solution is not completely satisfying in continuous operation.

Figure 2:
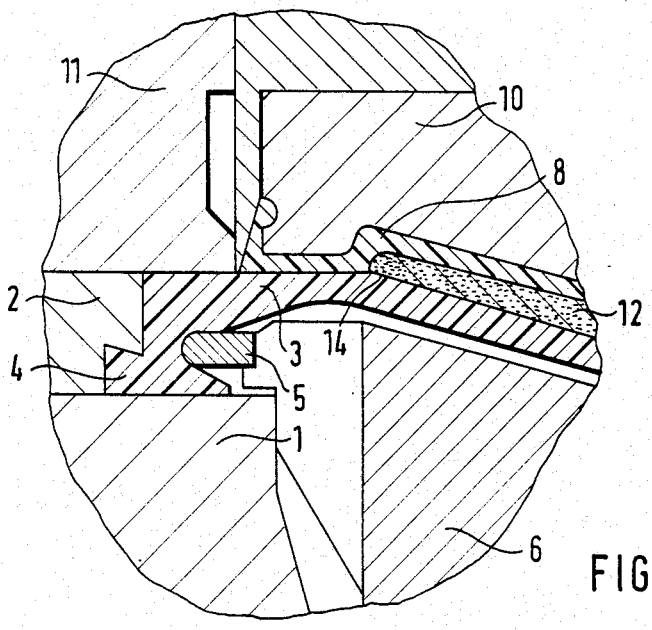
Figure 3:
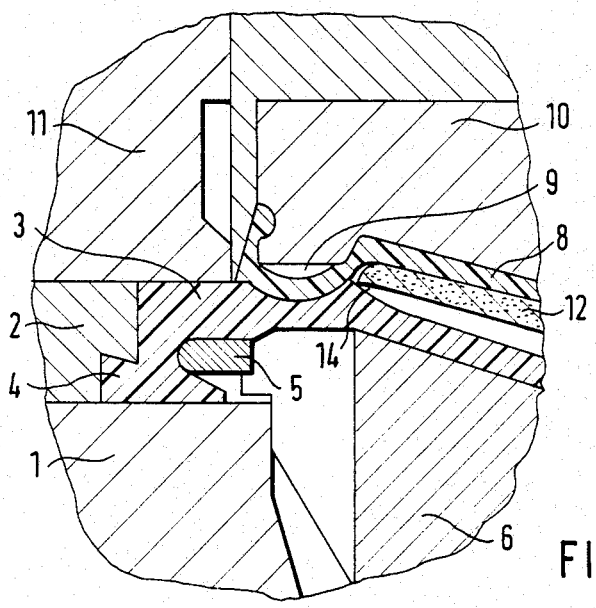
Figure 4:
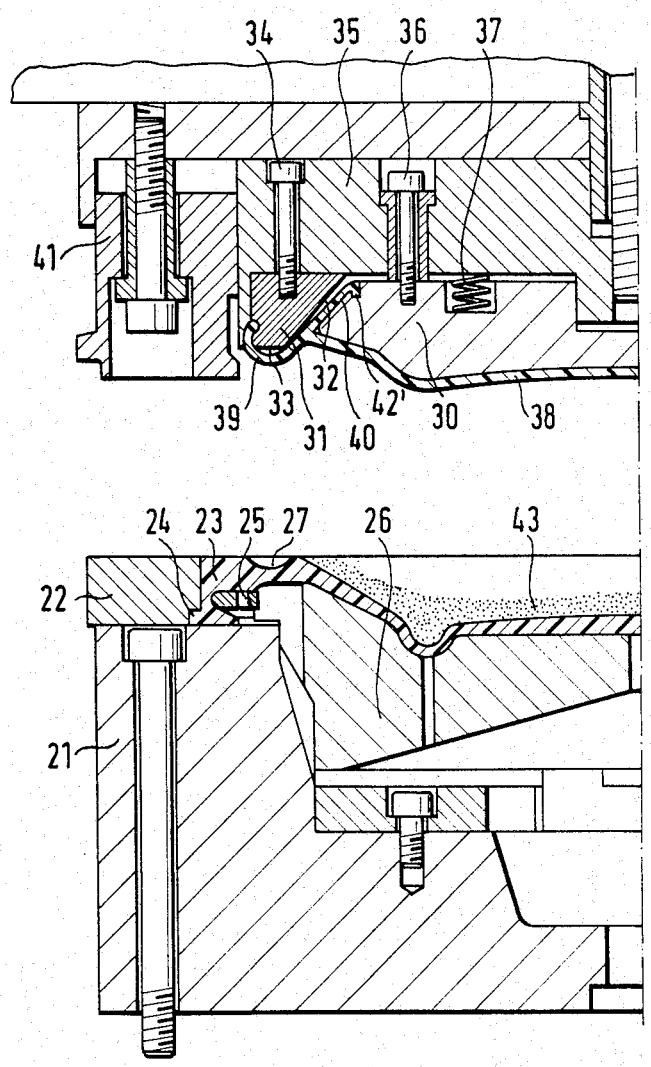

The figures show the following:

FIG. 1 a partial section of a vertical press in a longitudinal view, a ceramic mass in powder form being filled onto the membrane located above the countermold and the press die being spaced away from the countermold FIG. 2 the press in a closed state being acted upon by a pressure medium, in a cutaway view FIG. 3 the press still closed, after the pressure medium has been let off FIG. 4 a partial section of a further embodiment of a vertical press in a state similar to that shown in FIG. 1

Figure 5:
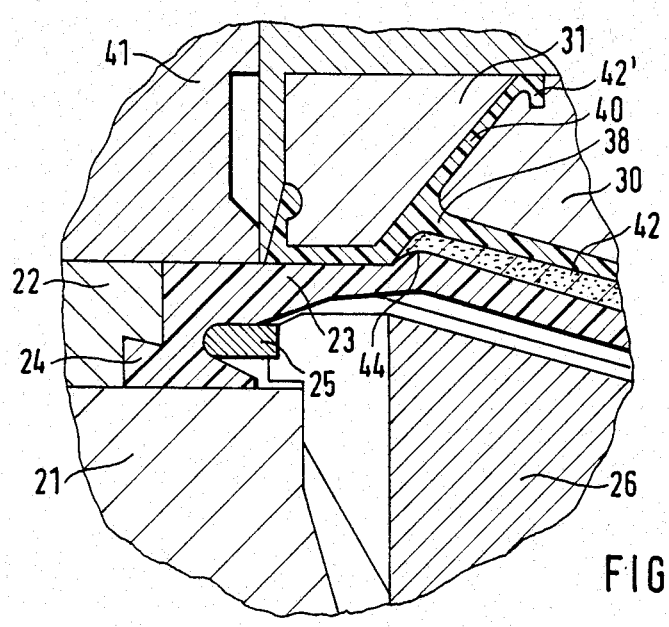
Figure 6:
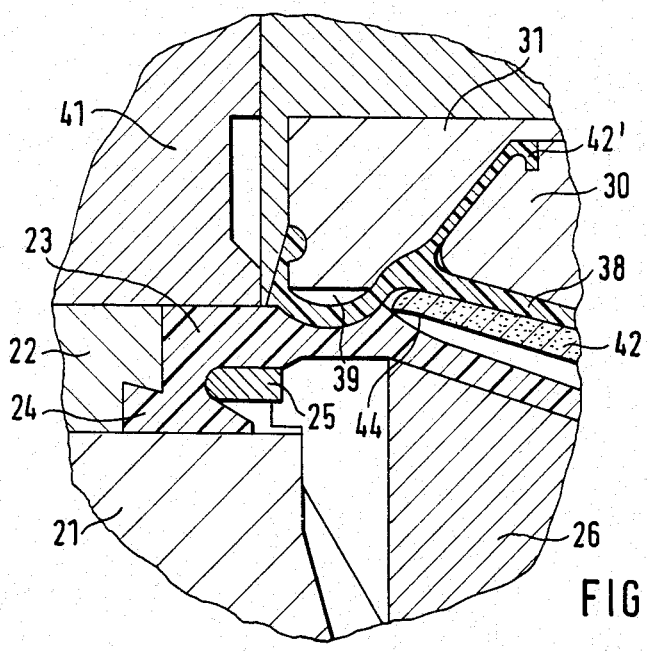

FIG. 5 the press as in FIG. 4 in a closed state being acted upon by a pressure medium, in a cutaway view FIG. 6 the press still closed, after the pressure medium has been let off The countermold is indicated by 1 and has a supporting ring 2 placed on it to hold membrane 3 via a projection 4. Membrane 3 is also held by a ring 5 in insert 6. Insert 6 shows punctures so that the pressure medium can be put into effect onto the membrane directly below it. The membrane is provided at the edge with an uninterrupted annular groove 7 on the side opposite the press die.

Press die 10 has a coating 8 with a torus 9 arranged exactly opposite annular groove 7. In the embodiment shown, this torus 9 is a hollow bulge.

When press die 10 along with ring 11 is placed on membrane 3, membrane 3 is fixed in the edge area, so that, when the underside of the membrane is acted upon by a pressure medium, the plate indicated schematically by 12 is produced from the porcelain body in powder form indicated by 13 in FIG. 1.

When isostatic pressure is applied, the pressure medium goes under annular groove 7, thus bulging membrane 3 upwardly in this area. At the same time, torus 9, as shown in FIG. 2, is pressed smooth and deformed towards the inside, so that plate rim 14 is pushed towards the inside. In the stage shown in FIG. 2, the finished pressed plate is produced. In the next stage the pressure medium is released so that torus 9 in press die coating 8 and annular groove 7 in the membrane return to their original positions, as can be clearly seen in FIG. 3. In the process the torus material is removed a certain distance away from the rim of the finished pressed plate 12, as can be clearly seen in FIG. 3. Thus plate rim 14 is released and the plate can be removed without difficulty after the press is opened.

In FIG. 4, the countermold is indicated by 21 and has a supporting ring 22 placed on it to hold membrane 23 via a projection 24. Membrane 23 is also held by a ring 25 in insert 26.

Insert 26 shows punctures so that the pressure medium can be put into effect directly onto membrane 23. The membrane is provided at the edge with an uninterrupted annular groove 27.

In this embodiment the press die comprises an inner die portion 30 and a conical ring 31 enclosing this inner die portion 30, the conical ring 31 protruding towards countermold 21 and having an inner boundary surface 32 extending from the inside to the outside. Apex 33 is flat. Conical ring 31 is attached by screws 34 to base body 35 of the press die. Inside the conical ring there is inner die portion 30 which is also attached by screws 36 to base body 35, but with play and against the effect of pressure springs 37. There is a coating 38 extending over inner die portion 30 and conical ring 31, this coating 38 having a torus 39 above apex 33 of conical ring 31. Base body 35 is surrounded by a spring-mounted ring 41. When the press is opened, the porcelain body indicated by 43 is applied to the membrane.

At the point of transition between inner die portion 30 and conical ring 31, coating 38 has a projection 40 pointing towards the interior of the press die, this projection 40 being fixed via a bulge 42 at the end of the inclined plane essentially parallel to boundary surface 32 on inner die portion 30.

During pressing, ring 41 is first placed on the edge of countermold 21 and the outermost edge of membrane 23, thus fixing membrane 23 in the edge area. When the press die is lowered further, coating 38 hits the filled in porcelain body via inner die portion 30 and is raised relative to conical ring 31 against the action of springs 37, thus displacing coating 38 in this area towards the inside. After the press is closed, a pressure medium is applied under membrane 23, and finished plate 42 is produced from porcelain body 43 (cf. FIG. 5).

When the isostatic pressure is applied, the pressure medium also goes under membrane 23 in the area of annular groove 27, causing membrane 23 to bulge out. At the same time, torus 39 is also pressed flat. All corresponding forming parts of the press thus surround the porcelain body so that the plate rim is completely finished on all sides (cf. in particular FIG. 5).

When the pressure of the pressure medium is released under membrane 23, springs 37 press inner die portion 30 and coating 38 with torus 39 back into their original positions, and plate rim 44 is released, as shown in FIG. 6.

The invention press is of course not only suitable for producing plates with scalloped rims, it may also be advantageously used for plates with smooth edges, because the problem of removal from the mold plays a part in such cases as well. The invention is not restricted to vertical presses, either. The problem depicted at the outset arises, and may be solved according to the invention, in the case of horizontal presses as well.

I claim:

1. A press for manufacturing plate-like products having a countermold and a press die which can be closed against the countermold, this press die being shaped in accordance with the inner shape of the plate-like product to be pressed, the countermold having a cavity and an elastic membrane mounted at its edge for closing off the cavity which cavity corresponds to the dimensions of the finished plate, the membrane also having a shape corresponding to the base of the plate and being adapted to have porcelain in power form distributed thereover when the press die is separated from the countermold, the press die having a flexible coating, the membrane and the coating forming a plate shaping mold chamber therebetween, the coating being provided at its edge with a hollow torus bulging towards the membrane; the membrane having an annular groove aligned with and facing the torus for receiving the torus when the die press is closed against the countermold, means for pressurizing the cavity and forcing the membrane toward the die press to eliminate the groove, collapse the bulge and cause inward migration of the material of both the membrane and the coating to form a rounded upper portion of the edge of the product and locate at the lower portion of the edge of the product the wedge-shaped pinch-off of the mold cavity formed by the juncture of the coating and membrane.

2. A press as in claim 1 wherein a conical ring having a flat apex is firmly attached to the press die and protrudes towards the countermold and has an inner boundary surface slanting outwardly and toward the countermold, the torus in the coating being aligned with the flat apex of the conical ring, the press die having an inner die portion within the conical ring, said inner die portion being resiliently urged toward the countermold and having an outwardly slanting inclined plane corresponding to the slanted boundary surface of the conical ring, the coating being secured to both the conical ring and the inner die portion.

3. The press for manufacturing plate-like products as recited in claim 2 wherein springs are provided for resiliently urging the inner die portion toward the countermold.

4. A press as in claim 2, wherein the coating has a projection extending over the outwardly inclined plane of the inner die portion and having at its end a bulge, a groove in the inner die portion seating the bulge for securing the projection to the inner die portion.

5. A press as in claim 2 wherein the coating of the press die has a projection extending over the inclined plane of the inner die portion, means for securing the projection to in the inner die portion.

6. The press for manufacturing plate-like products as recited in claim 2 wherein the membrane before closure of the press has a ridge separating the groove from the inner portion of the membrane and defining a knife-like apex which seats against the torus as the press is closed, said ridge being forced inwardly and reshaped into a rounded protrusion inwardly of the juncture of the coating and membrane after the pressure cavity has been pressurized to locate the wedge-shaped pinch-off below the plane of the lower face of the pressure cavity adjacent the periphery thereof.

7. A press for manufacturing plate-like products having a countermold and a die press, the countermold having a flexible membrane and the die press having a flexible coating, means at the peripheries of both the coating and the membrane for securing them to the die press and the countermold respectively, the membrane and the coating together forming a product shaping mold cavity therebetween when the press is closed, the countermold having a pressure cavity closed by the membrane, the coating having an annular torus adjacent its edge bulging toward the membrane and the membrane having a groove aligned with and facing the torus for receiving the torus when the press is closed, means for pressurizing the pressure cavity while the press is closed to displace the membrane sufficiently to eliminate the groove, collapse the torus and cause inward migration of the material of both the membrane and the coating to form a rounded upper portion of the edge of the product and locate at the lower portion of the edge of the wedge-shaped pinch-off of the mold cavity formed by the juncture of the coating and membrane.

8. The press for manufacturing plate-like products as recited in claim 7 wherein the torus is hollow.

9. A press for manufacturing plate-like products having a countermold and a press die which can be moved against the countermold, this press die being shaped in accordance with the inner shape of the plate-like product to be pressed, the countermold having a pressure cavity and a flexible membrane secured at its edge for closing off the pressure cavity, the membrane having a shape corresponding to the base of the plate and being adapted to have porcelain in powder form distributed thereover when the press die is separated from the membrane, the press die having a flexible coating, the membrane and the coating forming a plate shaping mold chamber therebetween, the coating being provided at its edge with a torus bulging towards the membrane; the membrane having an annular groove aligned with and facing the torus for receiving the torus when the die press is closed against the countermold, means for pressurizing the pressure cavity and forcing the membrane toward the die press to eliminate the groove, collapse the bulge and cause inward migration of the material of both the membrane and the coating to form a rounded upper portion of the edge of the product and to locate the product edge inwardly of both the torus and the peripheral edge of the mold cavity when the press is opened.

* * * * *